US005408774A

United States Patent [19]

Grewe et al.

[11] Patent Number: 5,408,774

[45] Date of Patent: Apr. 25, 1995

[54] COUNTERTOP ADJUSTABLE AND CHANGEABLE SIGN HOLDER

[75] Inventors: Ronald E. Grewe, Novi; Gary D. Rigby, West Bloomfield, both of Mich.

[73] Assignee: Marketing Displays, Inc., Farmington Hills, Mich.

[21] Appl. No.: 43,360

[22] Filed: Apr. 6, 1993

[51] Int. Cl.[6] ..... G09F 15/00

[52] U.S. Cl. ..... 40/606; 248/291; 248/349; 403/107; 40/132.1

[58] Field of Search ..... 40/606, 642, 649, 611, 40/358, 341, 492, 533, 536; 248/185, 291, 923, 349; 403/103, 104, 106, 107, 294, 292

[56] References Cited

U.S. PATENT DOCUMENTS 1,436,544 11/1922 Starr ..... 248/349
4,134,222 1/1979 Orsos ..... 40/606
4,557,064 12/1985 Thompson .
4,786,025 11/1988 Shuman ..... 40/606 X
4,881,707 11/1989 Garfinkle ..... 40/642 X
5,031,870 7/1991 Higgins .

OTHER PUBLICATIONS

New! New! New! Suspenders Hanging track system, 1991.

*Primary Examiner*—Kenneth J. Dorner
*Assistant Examiner*—Cassandra Davis
*Attorney, Agent, or Firm*—Brooks & Kushman

[57] ABSTRACT

A display device for removably displaying signs, posters and other advertising displays at varying viewing angles. The display device includes a base member having a cavity therein, a holder member positionable within said cavity, and an attachment member for attaching an insert to the holder. The display device also includes a frictional orientation mechanism for adjusting the pivotal relationship of the base member and holder member, so that the viewing angle of the insert may be adjusted.

21 Claims, 6 Drawing Sheets

COUNTERTOP ADJUSTABLE AND CHANGEABLE SIGN HOLDER

TECHNICAL FIELD

The present invention relates generally to devices for displaying signs, posters and the like for promotional and informational purposes. More particularly, the invention relates to adjustable display devices for holding and displaying changeable cards and signs in business establishments.

BACKGROUND ART

There are numerous devices and frames known today used for displaying various signs, messages and advertisements to the public. These devices can be positioned or secured on walls, countertops, frames and supports or suspended from ceilings or wall surfaces. One example is a hanging track system manufactured by Marketing Displays International, of Farmington Hills, Mich. This track system, marketed under the tradename "SUSPENDERS", suspends posters and banners from a wall or ceiling by using retaining members and a holder. The retaining members grip the poster or banner and engage the holder so that the holder suspends the poster or banner. This system is limited for use to wall surfaces or ceilings.

Another example of a known sign display device is disclosed in Higgins, U.S. Pat. No. 5,031,870. Higgins discloses a display device for releasably supporting cards and signs which can be positioned on a counter, cash register or the like. The device contains a frame having a slot or aperture for receiving part of display card. A manually operable mechanism is used to secure the display card to the frame.

The securing means employed in Higgins is expensive and complex and does not allow the user to display the message at various angles. Because the intended view of the message displayed may be above or below the level of the display, this disadvantage may place the message out of the intended viewer's most convenient field of vision.

DISCLOSURE OF THE INVENTION

An object of the present invention is to provide a sign and card display device that can display a card or sign from a countertop or the like at variable angles.

Another object of the present invention is to provide a countertop-type sign and card display device to which different signs and cards may be attached and detached quickly and easily.

Still another object of the present invention is to provide a sign and card display device that can accommodate changeable signs and can be manufactured at low cost.

A further object of the present invention is to provide a sign and card display device that can accommodate changeable signs, and is simple to manufacture and use.

Another further object of the present invention to provide a sign and card display device, particularly for countertop-type situations, which overcomes all the aforementioned problems.

In accordance with the present invention, a display device for displaying signs and cards on a countertop-type surface at various angles is provided which has a means for holding a sign or card securely in place, and yet at the same time allows for that sign or card to be quickly and easily changed.

The present invention can also be mounted on a wall or over a doorway, for example, and set at a convenient angle to be easily viewed standing at floor level.

The present invention comprises a base member having a cavity therein, a holder member positioned within the cavity, and a means for attaching an insert to the holder member. The display device further comprises means for adjusting the pivotal relationship of the holder member and the base member, whereby the viewing angle of the insert may be adjusted.

The means for adjusting the pivotal relationship of the members preferably comprises a plurality of friction members attached to or incorporated in the base member and extending into the base cavity. The friction members may be included as part of the base member, or as part of end cap members which are positioned on the ends of the base member. The friction members preferably are engageable with an opening in the holder member. The friction members may alternatively be attached to or comprise a part of the holder member, and be engageable with openings or recesses in the base member.

The means for adjusting the pivotal relationship of the members may also comprise a plurality of ridges, nubs or other raised members attached to the base member or holder member, and corresponding recesses in the holder member or base member, respectively. In another alternative, the means for adjusting the pivotal relationship of the members may comprise a frictional surface attached to the base member or the holder member, or both, that prevents the holder member from pivoting freely within the base cavity.

The means for attaching the insert may include a frame member tightly secured in the holder member. Alternatively, it may comprise one or more retainer members having a plurality of gripping members that secure the insert when it is positioned into the retaining member.

BEST MODE(S) FOR CARRYING OUT THE INVENTION

FIGS. 1–5 illustrate an embodiment of a display device according to the present invention for use in displaying an advertising sign or card on the top of a cash register. It will be readily understood by one skilled in the art, however, that the present invention is not limited to use on cash registers, but is adapted for a wide variety of uses whenever it is desired to securely retain and display changeable signs or cards at different angles and positions. The present invention can be used, for example, on a countertop, table, or other similar surface.

For ease of reference the display device for signs and/or cards according to the present invention will be referred to herein by the term "display device." In addition, the signs, cards or other advertisements that may be displayed with the display device will be referred to herein by the term "sign." These terms are not meant to be used in any limiting manner, but simply to provide for ease of reference in describing the invention.

Figure 1:
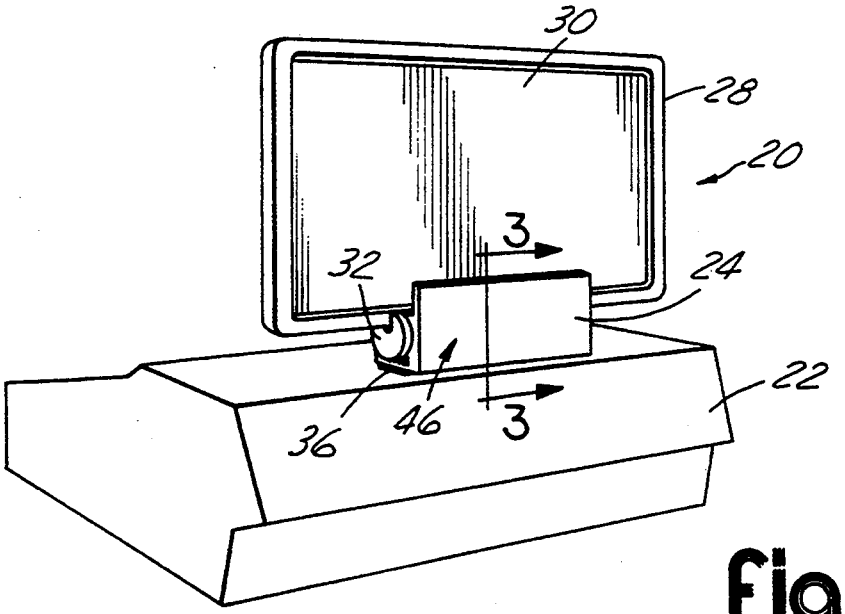
FIG. 1 is a perspective view of a display device according to the present invention for displaying a sign or card on the top of a cash register.
Figure 2:
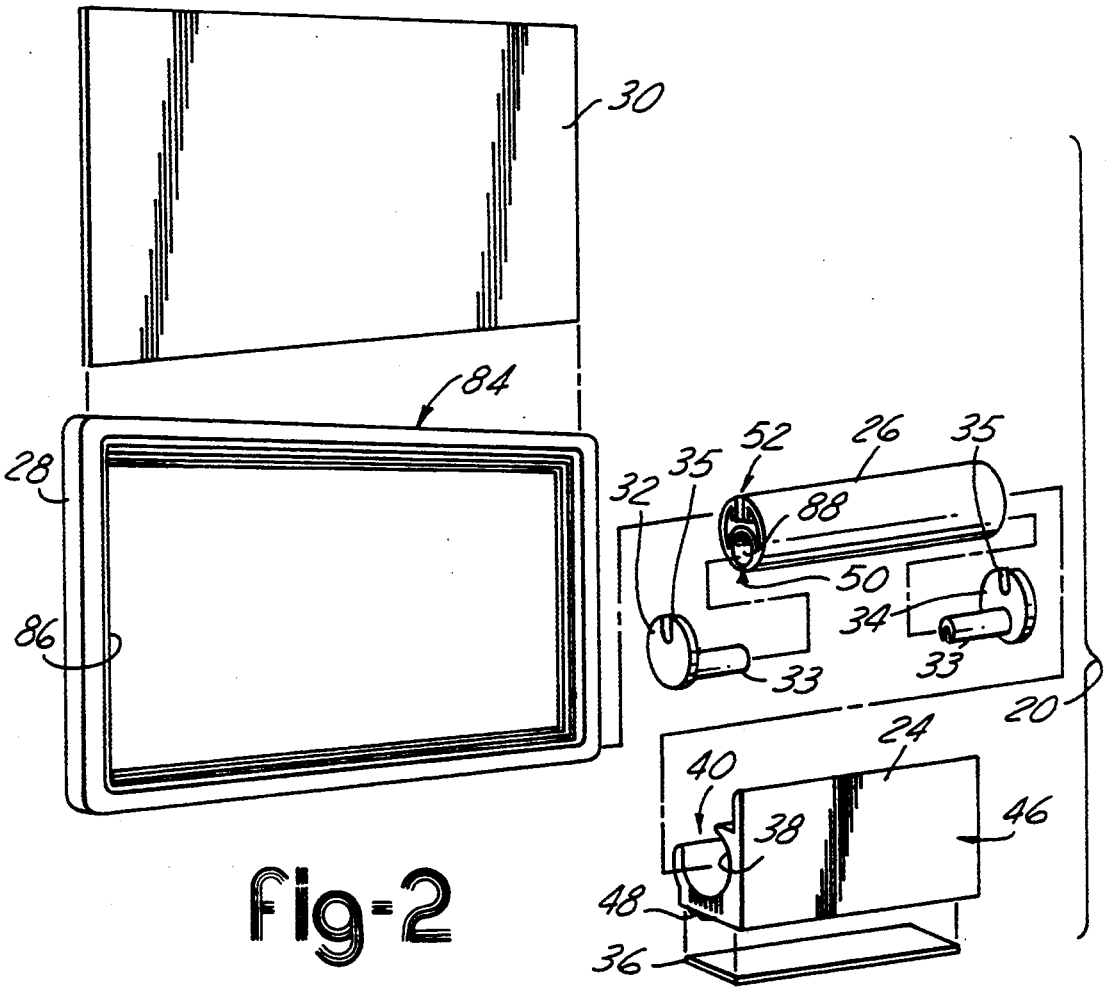
FIG. 2 is an exploded view, in perspective, of the display device of FIG. 1.

FIG. 1 illustrates an embodiment of the display device 20 in use on a cash register 22. FIG. 2 illustrates an exploded view of the display device 20 shown in FIG. 1. As shown, the display device 20 comprises a base member 24, a holder member 26, a frame member 28, a sign 30, two end caps 32 and 34, and an attachment strip 36.

The base 24 member has an inner wall 38 that defines a cavity 40. In the embodiments of the display device as shown in FIGS. 1–10, the cavity 40 has two portions. The first portion 42 is generally cylindrical in shape and the second portion 44 forms a recess opening into the cylindrical portion.

The base 24 preferably is extruded or molded from a plastic material in the shape shown, although the base could be made from any structural material which has the properties to fulfill the objects and purposes of the present invention. The plastic material preferably is ABS or high impact styrene. The front face 46 of the base is preferably flat so that an appropriate advertisement or promotional message (not shown) can be printed on it or attached to it.

The base member 24 as shown in FIGS. 1–5 contains a plurality of flexible and resilient friction members or fingers 48 that extend from recess 44 into the cylindrical portion 42. The particular embodiment shown in FIGS. 1–5 has five fingers 48; other embodiments could have a greater or fewer number of fingers. Preferably, at least three fingers are provided. The fingers may extend the entire axial length of the cavity 40, or may occupy only selected portions of the cavity.

If the base is extruded or molded from a plastic material, the finger members 48 may be molded together with the base, as one piece. Alternatively, if the base is formed from another material, such as wood, the fingers may be separately molded from a plastic or elastomeric material and then attached to the base by any suitable bonding or attachment means.

The holder 26 is generally cylindrical and is dimensioned to rotatably fit within cavity 40. The holder is preferably made of extruded aluminum in the shape shown. Opening 50 is formed longitudinally along the length of holder 26 for mating with the fingers 48 as discussed below. Opening 52 is also formed longitudinally along the length of the holder opposite opening 50 and used to hold and display the frame 28 and sign 30.

Guide flanges or members 54 and 56 are formed in the extruded holder 26 and used to hold and retain frame 28 or other sign securing means. Curved inner member 58 is also provided in the holder and used to hold the extrusion together, as well as to provide a support or stop for frame 28.

Figure 5:
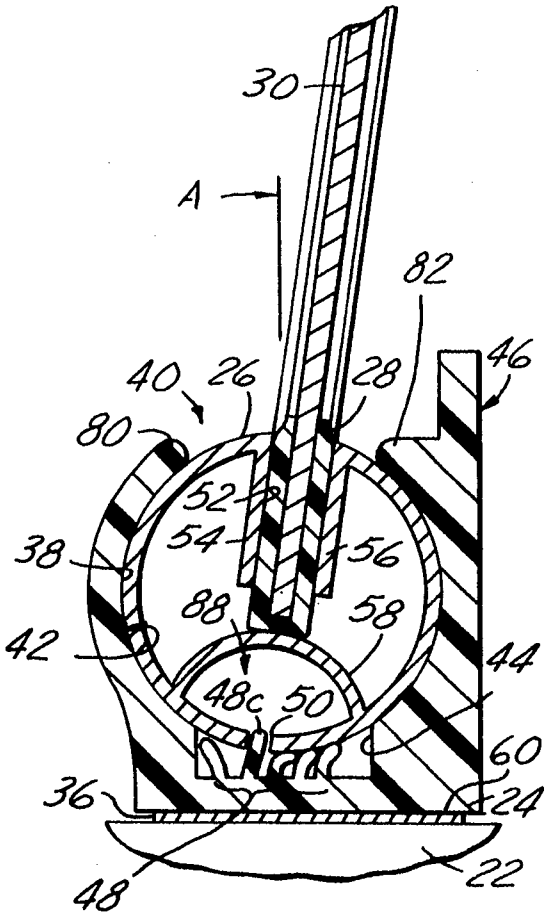
FIG. 5 is a cross-sectional view similar to that of FIGS. 3 and 4 wherein the display of the display device according to the present invention is tilted in the opposite direction.
Figure 3:
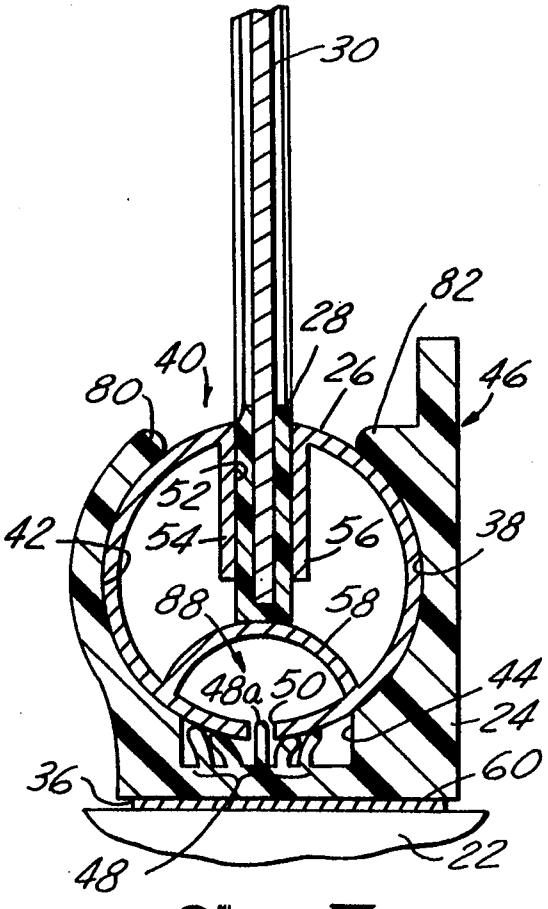
FIG. 3 is a cross-sectional view, taken along line 3—3 of FIG. 1.
Figure 4:
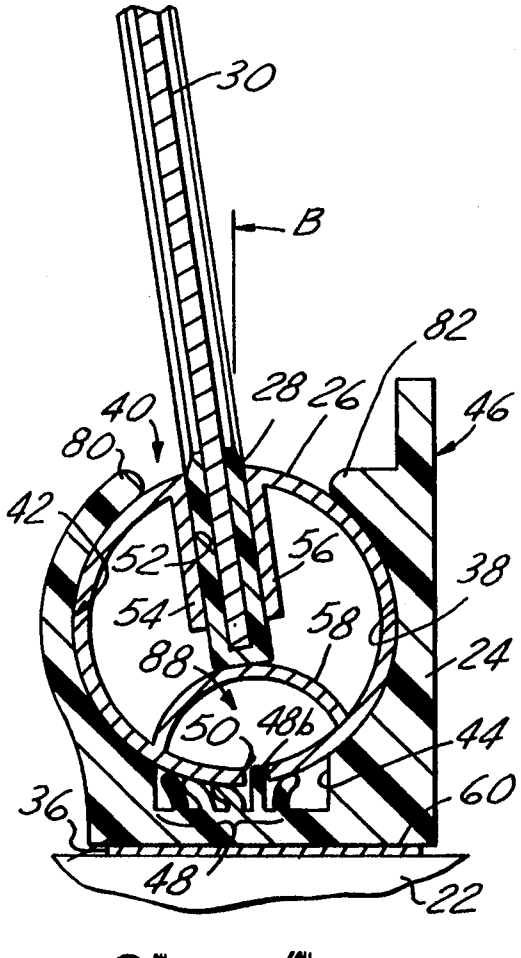
FIG. 4 is a cross-sectional view similar to that of FIG. 3 wherein the display card of the display device according to the present invention is tilted in one direction.
Figure 6:
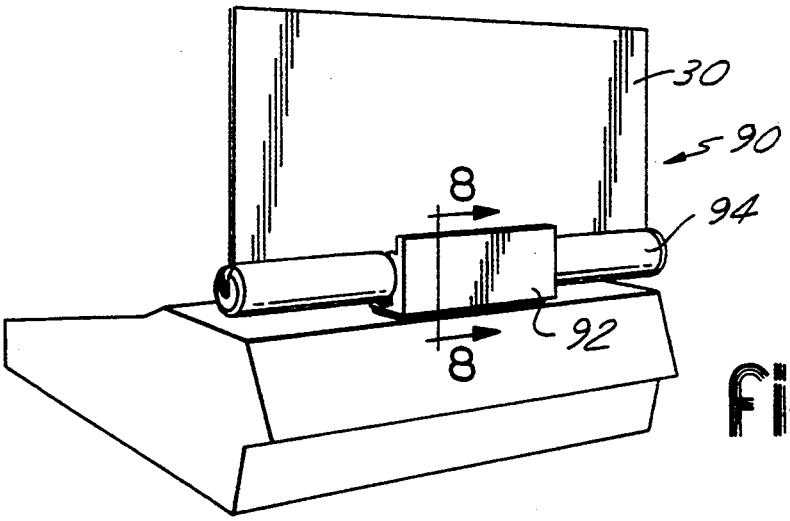
FIG. 6 is a perspective view of an alternative embodiment of a display device according to the present invention for displaying a sign or card on the top of a cash register.

Referring to FIGS. 3–5, when the holder 26 is positioned in the cavity 40 in its vertically upright position (FIG. 3), one of the fingers 48a protrudes into opening 50. This engagement between the holder 26 and finger 48*a* prevents the holder from freely rotating within the cavity 32 without manual force being applied.

The holder 26 can rotate around its axis within the cavity 40. As is shown in FIGS. 4 and 5, as the holder is rotated within the cavity, a different finger 48*a* or 48*b* protrudes into the holder cavity 42.

The holder can be rotated forwardly, as shown in FIG. 5, or backwardly, as shown in FIG. 4. The rotatable holder enables the angle of the insert to be varied, depending on the position of the display device 20 and the viewer's line of sight. Moreover, the rotatable holder enables the user to use the display device on angled surfaces.

Referring to FIGS. 4 and 5, the holder 26 can be rotated forwardly so that angle A, the angle between the insert and a line perpendicular to the bottom surface 60 of the base, can reach 20°–30° (see FIG. 5). The holder can also be rotated backwardly so that angle B, i.e. the angle between the insert and the line perpendicular to the bottom surface 60 of the base can reach 50°–60° (see FIG. 4). It will be understood that the angles of rotation of the present invention are not limited to 20°–30° in one direction and 50°–60° in the other direction; these angles are given only as preferred ranges.

It should be understood that the cross-sectional shapes of the cavity 40 and holder 26 of the present invention are not limited to generally cylindrical shapes. For example, the base cavity may be square and the holder may have a plurality of sides, or vice versa. Moreover, the fingers of the present invention need not extend only from the lower portion of the base member into the cavity. They could also extend from the other portions of the inner base wall, such as side portions, into the base cavity. Alternatively, the fingers could extend from the holder into an opening in the base.

A plurality of ridges, nubs or other raised members also could be used in place of the fingers 48. If such ridges, nubs or other raised members were used, the raised members could interact with holder opening 50.

Figure 11:
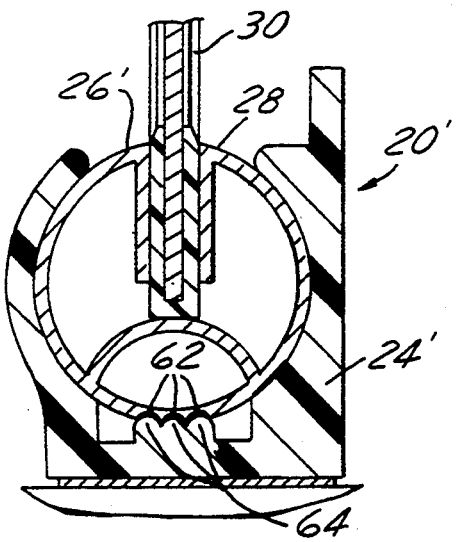
FIGS. 11 and 12 illustrate still other embodiments of the invention.

Alternatively, as shown in FIG. 11, the holder 26 of embodiment 20' could be modified to contain a plurality of longitudinal recesses 62, rather than an opening, that would mate with raised members 64 on the base 24'. The ridges, nubs or other raised members could alternatively be located on the holder and the openings or mating recesses located on the base.

Figure 12:
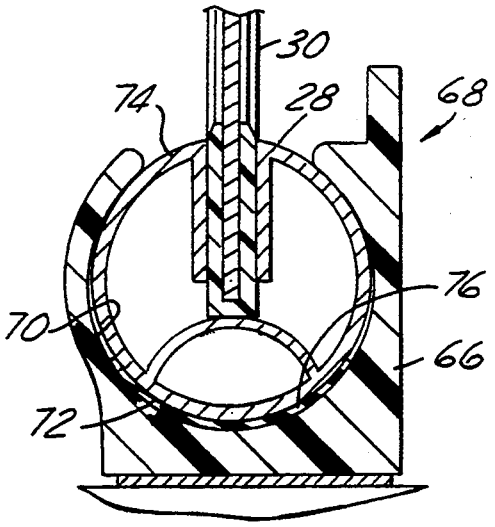

Referring to FIG. 12, the base member 66 of the display device 68 could alternatively comprise a fingerless frictional surface 70, engageable with a corresponding frictional surface 72 on the holder member 74. Such frictional surfaces could be made of plastic, rubber, or any other suitable frictional material or coating 76 that would allow a user to manually rotate the holder member and yet prevent the holder from uninhibited rotation.

Referring back to FIGS. 1–5, the holder member 26 and the generally cylindrical portion 38 of the cavity 40 are dimensioned so that the holder fits snugly into the cavity. The base has overlapping flanges 80 and 82 that retain the holder in the base; the holder is positioned in and removed from the base preferably by sliding it longitudinally along its axis.

The frame member 28, which preferably is made from high impact styrene, fits snugly in the holder opening 52 between guide members 54 and 56. The frame 28 rests on inner support member 58.

The sign 30 can be a sign, card, or other similar structure which inserts in the frame 28. The advertisement or other message to be displayed in the display device 20 is printed on or otherwise attached to the sign. The sign 30 slides into the frame through a slot or opening 84 in the top edge of the frame. The center opening 86 of the frame 28 is open on both sides so the sign 30 can be viewed from either side.

Referring to FIG. 2, the display device also comprises removable end caps 32 and 34. The end caps have friction plugs 33 that insert into cavity 88 between the support member 58 and opening 50. The plugs secure the end caps to the holder and can only be removed manually. The end caps have U-shaped openings 35 to allow them to fit around the frame 28 when the caps are attached to the holder 26. Preferably, the end caps are made from a conventional plastic material, such as polypropylene or high density polyethylene.

The display device 20 can be secured to the surface on which it is to be displayed, such as cash register 22 shown in the drawings, by the attachment strip 36. The strip 36 may be magnetic for metallic surfaces, or adhesive for other surfaces.

FIGS. 6–10 illustrate an alternative embodiment 90 of a display device in accordance with the present invention. Device 90 also comprises a base member 92 and a holder member 94 similar to those of the embodiment shown in FIGS. 1–5. Similar aspects of the holder member and base member of the embodiments shown in FIGS. 1–5 and 6–10 are referred to by the same reference numbers.

In the alternative embodiment shown in FIGS. 6–10, the holder 94 is axially longer than the base 92, so that a significant portion of the holder extends out of the cavity 40. It should be understood, however, that the embodiment illustrated in FIGS. 1–5 could also have a holder that similarly extends out of the cavity.

Figure 7:
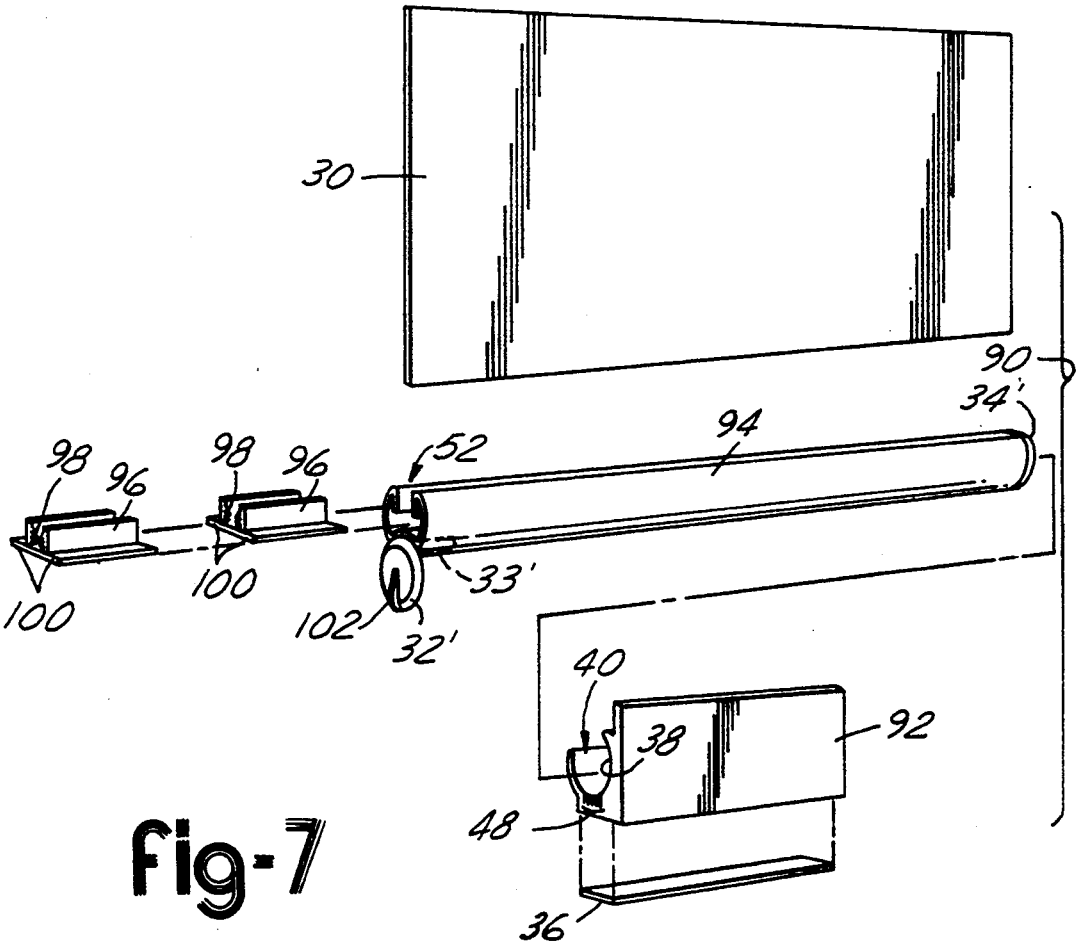
FIG. 7 is an exploded view, in perspective, of the alternative embodiment of FIG. 6.
Figure 8:
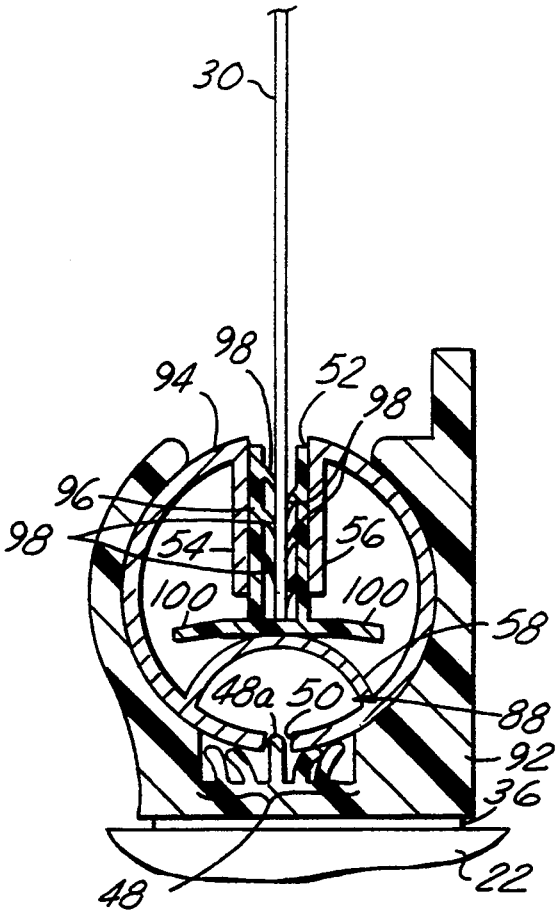
FIG. 8 is a cross-sectional view, taken along line 8—8 of FIG. 6.
Figure 9:
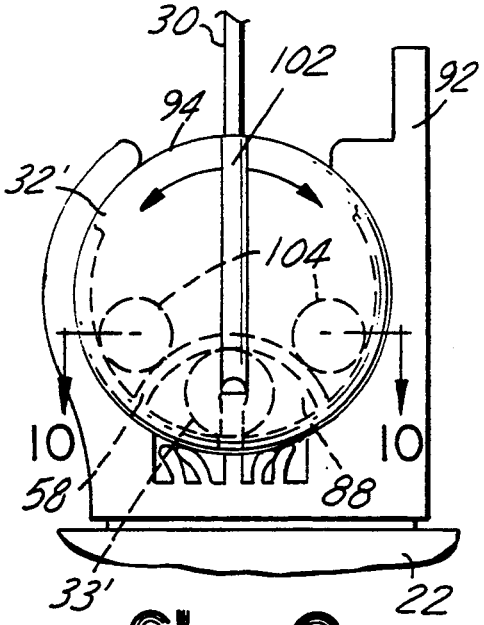
FIG. 9 is an end view of the alternative embodiment of the display device as shown in FIGS. 6 and 7.
Figure 10:
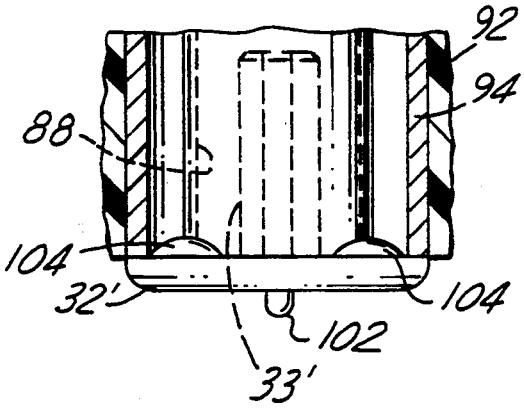
FIG. 10 is a cross-sectional view, taken along line 10—10 of FIG. 9.

Unlike the embodiment shown in FIGS. 1–5, however, the embodiment of FIGS. 6–10 does not include a frame. Instead, the sign 30 removably attaches to the holder 94 with one or more retaining members 96. The retaining members 96 contain a plurality of gripping members 98. Upon insertion of the sign 30 into the retaining member 96, the gripping members 98 are biased downward so that the sign remains secured by the retaining members until removal is manually desired. (This is shown in FIG. 8.)

The preferred retaining member is described in U.S. Pat. No. 4,557,064. It is available from Fasteners For Retail Co., Cleveland, Ohio.

The retaining members 96 are inserted into the holder 94 axially (as shown in FIG. 7). The sign 30 may be attached to the retaining members either before or after the retaining members are slid into the holder. Thus, the sign 30 may be attached to one or more retaining members 96, and the retaining members 96 placed or slid inside the holder 94 with the sign attached; or the retaining members 96 may be placed inside holder 94 first, and the sign then inserted downwardly into holder opening 52. In either case, the net effect is that the sign 30 is locked into position by the gripping members 98 in the retaining member 96.

Figure 17:
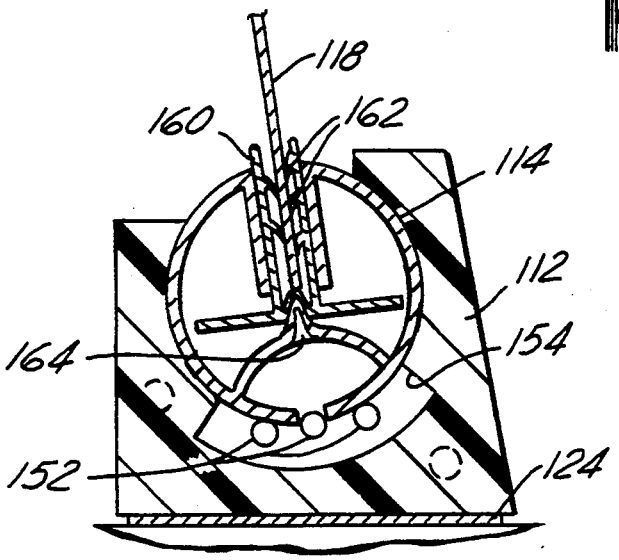

The retaining members 96 rest on internal holder wall 58 in the holder member 94. Outwardly extending flanges 100 on the base of the retaining member 96 prevent the retaining member from being removed through the holder opening 52. If it is necessary to secure retaining members 96 in place at certain longitudinal locations in holder member 94, the members 96 can be staked or otherwise securely attached in place as is shown in FIG. 17 and more fully described herein. Also, it is possible to provide only one longer retaining member 96 in holder 94 to hold sign 30, rather than the two shorter members 96 as shown in FIG. 7.

Because the display device illustrated in FIGS. 6–10 does not contain a frame, the material of the sign 30 should be self-supporting, i.e., it should be sufficiently rigid to support itself.

As illustrated in FIG. 7, display device 90 further includes end caps 32' and 34'. The end caps are attached to the holder 94 by plugs 33'. Plugs 33' fit snugly into the holder cavity 88 so that the end caps remain attached to the holder unless removal is desired. Because the end cap is attached by a cylindrical plug 33', it can be rotated around the axis of the plug from a closed position shown in FIG. 9 to an open position, as shown in FIG. 7. A ridge 102 is provided on the outside of each end cap 32', 34' to allow manual rotation between the open and closed positions. The end caps further include two nubs or projections 104 adjacent plug 33' which retain the end caps in their closed positions unless otherwise desired.

Figure 13:
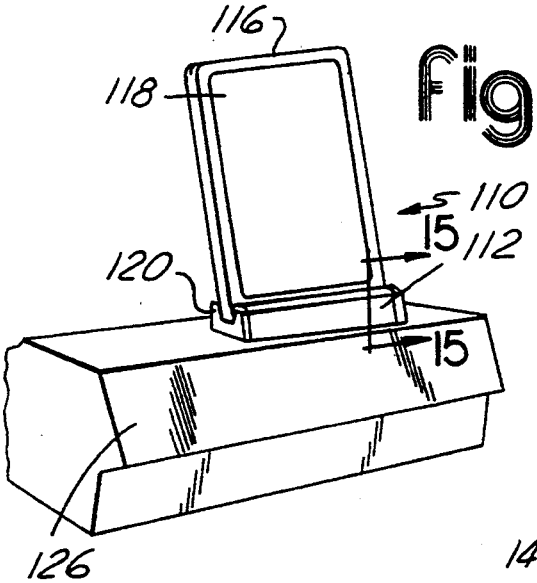
FIGS. 13–15 illustrate a preferred embodiment of the invention, with FIG. 13 being a perspective illustration of a display device according to the invention, FIG. 14 being an exploded view of the inventive display device shown in FIG. 13, and FIG. 15 being a cross-sectional view of the invention taken along lines 15—15 of FIG. 13 and in the direction of the arrows.
Figure 15:
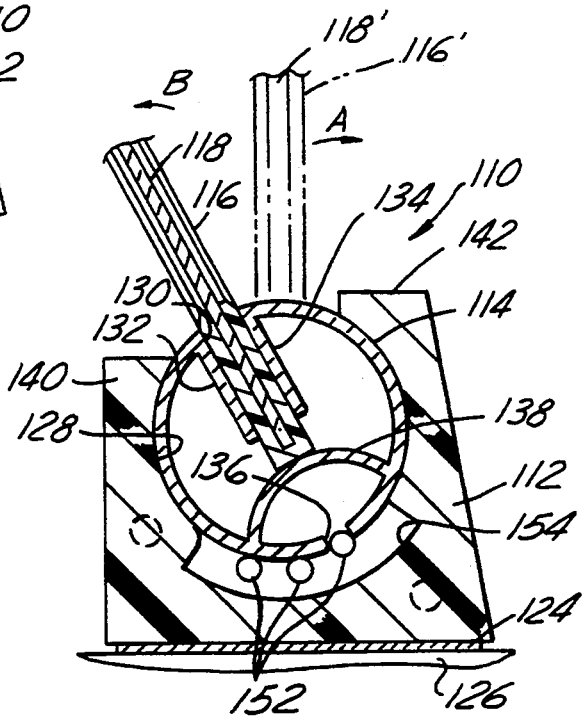
Figure 14:
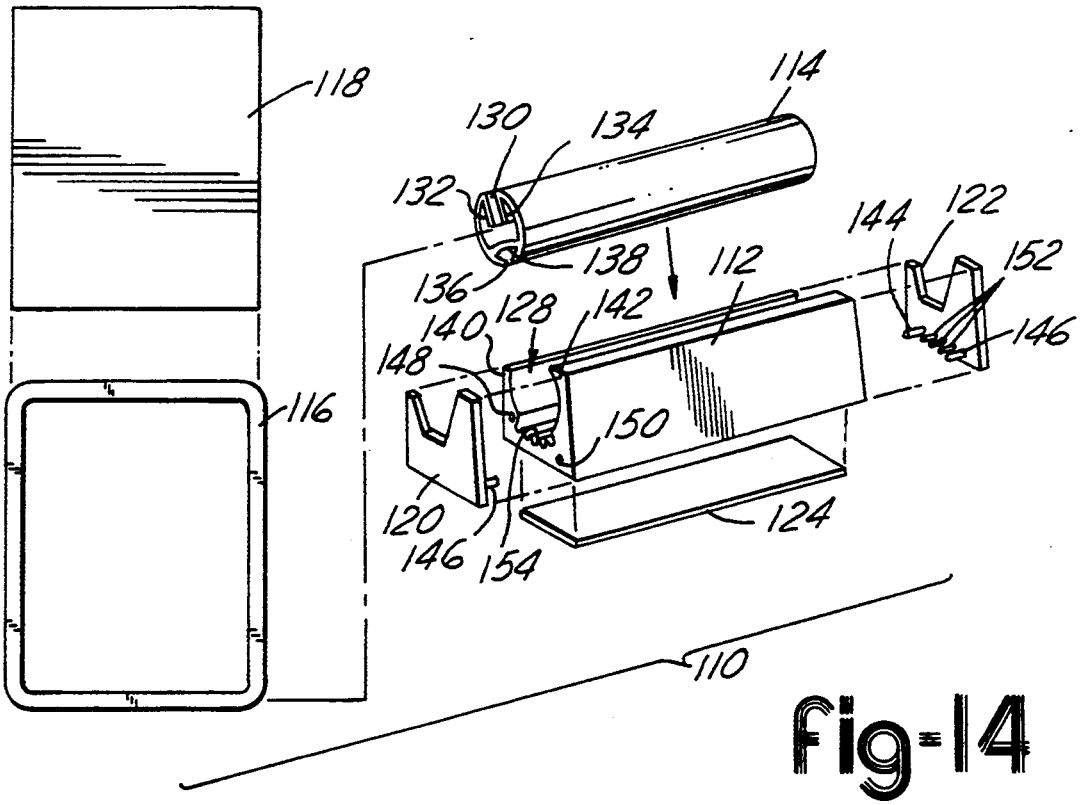

Another alternate embodiment of a display device in accordance with the present invention is shown in FIGS. 13–15. This is the most preferred embodiment of the invention at this time.

The display device is generally indicated by the reference numeral 110. The device 110 includes a base member 112, a holder member 114, a frame member 116 and an insert or sign 118. A pair of end caps 120 and 122 are also provided, as well as an attachment strip 124. The attachment strip 124 is either magnetic or covered with a tacky adhesive in order to secure the display 110 to a cash register 126 or the like.

The sign 118 is positioned inside frame 116 and the frame 116 is positioned in the holder member 114. A slot (not shown) in the top of the frame is provided for insertion of the sign in the frame. The holder member in turn is rotatably positioned in cavity 128 in the base member 112.

The holder member has an elongated slot or opening 130 for holding the frame member and sign. The frame is wedged or force fit within guide flanges 132 and 134 on the holder member 114 and is held securely in place. Preferably the width of the frame is coextensive with the length of the base member 112, although it is understood that the frame member can be longer or shorter as desired.

The holder member 114 has a second slot or opening 136 opposite opening 130. A curved support member 138 is also provided in the holder member. The holder member 114 is positioned in curved cavity 128 in the base member either longitudinally, or by rotating it around its axis as it is being forced into the cavity 128. Once the holder 114 is positioned in the base member, it is held in place by end caps 120, 122 and by upstanding walls 140, 142 of the base member which provide a cavity 128 greater than 180° in circumference.

End caps 120, 122 have two locking posts 144, 146 which fit within holes 148 and 150, respectively, in the base member 112. The posts 144, 146 are securely held in place by friction, locking tangs, glue or other securing or fastening means in the holes in the base member. Alternatively, the end caps 120, 122 could be glued or sonically welded to the ends of the base member. As shown in FIG. 13, the end caps 120, 122 cover a portion of the ends of the cavity 128, thus helping to secure the holder member in place and also to present a more aesthetically pleasing product.

In the same manner that the embodiments described above allow the frames and/or signs to pivot or rotate relative to the base members, the embodiment shown in FIGS. 13–15 also provides this same function. As shown in FIG. 15, the frame member 116 and sign 118 can rotate with the same degree of freedom as mentioned above, preferably from 30° forwardly ("A") to 60° backwardly ("B"). (This is illustrated schematically by reference numerals 116' and 118'.)

The location and orientation of the holder member 114 (and thus the frame member and sign) relative to the base member 112 is assisted by protruding finger members 152 provided on the end caps 120, 122. The finger members 152 are molded with or formed on the end caps and are positioned in recess 154 in the cavity 128 when the end caps are assembled on the base member. As shown in FIG. 15, the finger members 152 are positioned relative to cavity 128 such that they interfere with and press against the outer periphery of the holder member 114. When the holder member is assembled in the base member, the finger members of the end caps press against and frictionally engage the holder member.

The pressure and friction of the finger members 152 on the holder member 114 essentially allows an infinite number of orientations and positioning of the frame and sign relative to the base within the outer limits of the range of rotation. In addition, when opening 136 is positioned directly over one of the finger members 152, the finger member protrudes into the opening. This allows several points of additionally stable positioning of the holder member relative to the base member, and the operator can sometimes "feel" when these points are reached as the finger member "snaps" up into the opening 136.

Three finger members 152 are preferably provided on each of the end caps, but it is understood that a greater or smaller number can also be provided in accordance with the invention. The finger members 152 also can be of any length, but preferably have a sufficient length to overlap the ends of the holder member 114 by $\frac{1}{8}$–$\frac{1}{4}$ of an inch. The finger members 152, as well as the posts 144,146, are also tapered for ease of molding as well as for ease of assembly with the base member 112.

The base member 112, holder member 114, end caps 120, 122 and frame member 116 are preferably made of the same materials and made in the same way as their counterparts discussed above with reference to FIGS. 1–12.

Figure 16:
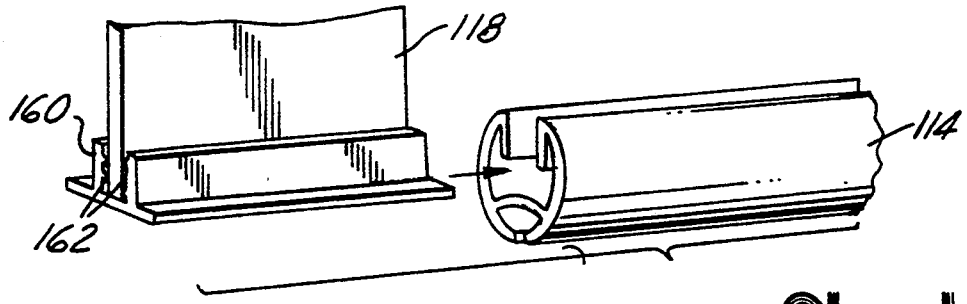
FIGS. 16 and 17 depict an alternate embodiment of the inventive display device of FIGS. 13–15 in which the insert (sign) is held in place in an alternative manner.

An alternate embodiment of the display device 110 is shown in FIGS. 16–17. In this embodiment, rather than having the sign 118 be positioned in a frame, the sign is held in place in the holder member 114 by a retaining member 160. The retaining member 160 is similar to the retaining member 96 described above with reference to FIGS. 6–10 and has a plurality of gripping members 162 which securely hold the sign 118 in place.

The retaining member 160 is slid longitudinally (axially) into holder member 114 and held in place by staking (as shown by reference numeral 164 in FIG. 17). The staking together of members 160 and 114 prevents the retaining member 160 from sliding along the holder and from becoming discentered in the display device. End caps (not shown) similar to end caps 120, 122 discussed above are provided on each end of the base member 112. The sign 118 is positioned in the display device after the retaining member, holder member, base member and end caps are assembled together.

Holder member 114 is rotatably positioned in base member 112 preferably in the same manner as described above with reference to FIGS. 13–15. Finger members 152 provide a frictional and positioning force and allow the sign 118 and holder member 114 to be oriented within base member 112 in a similar manner.

Figure 18:
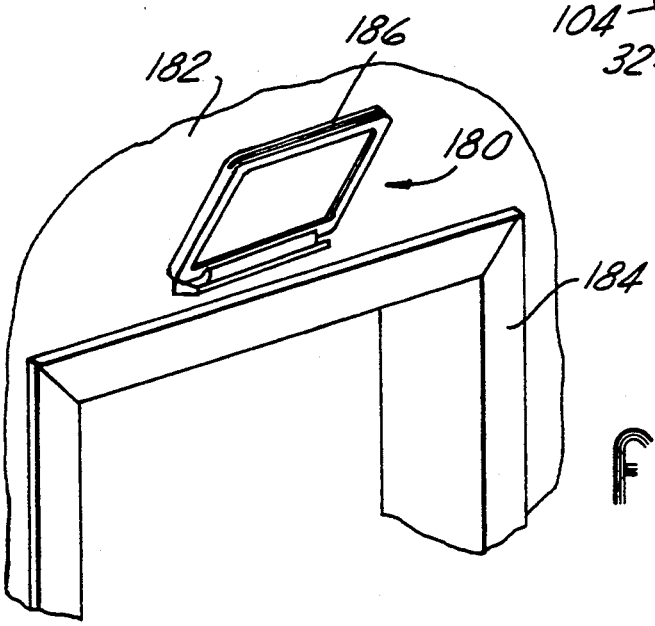
FIG. 18 depicts use of the present invention on a wall over a doorway.

FIG. 18 illustrates another use of the present invention. The device 180 is securely mounted to a wall 182 over a doorway 184. The insert 186 is set at a convenient angle so it can be easily viewed by persons in the room or passing through the doorway. The device 180 can be glued or otherwise securely fastened to the well, or magnets can be used to secure it to the doorway if the frame is metal.

It is understood, of course, that while the form of the invention herein shown and described constitutes the preferred embodiment of the invention, it is not intended to illustrate all possible forms thereof. It will also be understood that the words used are words of description rather than limitation, and that various changes may be made without departing from the spirit and scope of the invention as disclosed.

We claim:

1. An adjustable sign display device for displaying signs at varying angles relative to a display surface comprising:

a base member adapted to be positioned on said display surface;

a holder member pivotably positioned in said base member;

attaching means for attaching a sign to said holder member; and adjusting means for adjusting the pivotal position of said base member with respect to said holder member, said adjusting means having at least one positioning member for indexing the relative position of said holder member relative to said base member;

said holder member having at least one opening therein and wherein said positioning member is engageable with said opening;

whereby the viewing angle of said sign may be adjusted with respect to said display surface.

2. An adjustable sign display device for displaying signs at varying angles relative to a display surface comprising:

a base member adapted to be positioned on said display surface;

a holder member pivotably positioned in said base member;

attaching means for attaching a sign to said holder member; and adjusting means for adjusting the pivotal position of said base member with respect to said holder member, said adjusting means comprising a plurality of positioning members for indexing the relative position of said holder member relative to said base member;

said holder member having at least one opening therein for mating with one of said positioning members, each of said positioning members being separately engageable with said opening; whereby the viewing angle of said sign may be adjusted with respect to said display surface.

3. An adjustable sign display device for displaying signs at varying angles relative to a display surface comprising:

a base member adapted to be positioned on said display surface, said base member having two ends;

end cap members positioned at said two ends of said base member;

a holder member pivotably positioned in said base member;

means for attaching a sign to said holder member; and means for adjusting the pivotal position of said base member with respect to said holder member, whereby the viewing angle of said sign may be adjusted with respect to a display surface.

4. The sign display device in accordance with claim 3 further comprising at least one opening in said holder member, and wherein said means for adjusting the pivotal position of said base member with respect to said holder member comprises a plurality of positioning members on at least one of said end cap members, said positioning members being separately engageable with said at least one opening for indexing the pivotal position of said holder member relative to said base member.

5. An adjustable sign display device for displaying signs at varying angles relative to a display surface comprising:

a base member adapted to be positioned on said display surface;

a holder member pivotably positioned in said base member, said holder member having two ends;

end cap members positioned in said two ends of said holder member;

means for attaching a sign to said holder member; and means for adjusting the pivotal position of said base member with respect to said holder member, whereby the viewing angle of said sign may be adjusted with respect to said display surface.

6. An adjustable counter sign device comprising:

a base member having a cavity therein and two ends;

end cap members positioned on the ends of the base member;

at least one positioning member extending into said cavity;

a holder member positioned within said cavity, the holder having means for engaging said positioning member; and means for attaching a sign to said holder member.

7. An adjustable counter sign device according to claim 6 further comprising a frame member capable of receiving said sign and positionable in said holder member.

8. An adjustable counter sign device according to claim 6 further comprising a retaining member positioned inside said holder member and removably engageable with said sign, so that the sign can be removably attached to the holder member when the retaining member is positioned inside the holder member.

9. An adjustable counter sign device according to claim 6 comprising a plurality of positioning members.

10. An adjustable counter sign device according to claim 6 and wherein said base member and cavity are elongated and wherein said positioning members extend the longitudinal length of said base cavity.

11. An adjustable counter sign device according to claim 6 wherein said base cavity is generally cylindrical.

12. An adjustable counter sign device according to claim 6 wherein said base cavity has a first portion of generally cylindrical shape, and a second portion that forms a recess.

13. An adjustable counter sign device according to claim 6 wherein said holder member is pivotable relative to said base cavity.

14. An adjustable counter sign device according to claim 13 wherein said sign device is adapted to display signs at varying angles relative to a counter surface, and wherein said holder member is pivotable in one direction to a position where the angle between the sign and an associated counter surface is 20°–30° and in a second direction to a position where the angle between the sign and to associated counter surface is 50°–60°.

15. An adjustable counter sign device according to claim 6 wherein said positioning member is positioned on at least one of said end cap members.

16. An adjustable counter sign device comprising:

a base member having a cavity therein;

said cavity having a first portion of generally cylindrical shape and a second portion that forms a recess;

at least one positioning member extending into said cavity;

a holder member positioned within said cavity, the holder having means for engaging said positioning member; and means for attaching a sign to said holder member.

17. An adjustable counter sign device comprising:

a base member having a cavity therein;

at least one positioning member extending into said cavity;

a holder member positioned within said cavity, the holder having means for engaging said positioning member;

means for attaching a sign to said holder member;

said holder member being pivotable relative to said base cavity for displaying said sign at varying angles relative to a counter surface, and wherein said holder member is pivotable in one direction to a position where the angle between the sign and an associated counter surface is 20°–30° and in a second direction to a position where the angle between the sign and an associated counter surface is 50°–60°.

18. An adjustable counter sign device comprising:

a base member having a cavity therein, said base member having two ends;

end cap members positioned on said two ends of said base member;

at least one positioning member situated on at least one of said end cap members and extending into said cavity;

a holder member positioned within said cavity, the holder having means for engaging said positioning member; and means for attaching a sign to said holder member.

19. The adjustable counter sign device as set forth in claim 18 wherein said means for engaging said positioning member comprises an opening in said holder member.

20. The adjustable counter sign device as set forth in claim 18 wherein each of said end cap members have at least one positioning member thereon.

21. The adjustable counter sign device as set forth in claim 18 wherein a plurality of positioning members are provided on said end cap member.

* * * * *